United States Patent [19]

Krautzberger

[11] Patent Number: 4,594,963

[45] Date of Patent: Jun. 17, 1986

[54] COATING DEVICE FOR COATING TRAVELING WEBS OF MATERIAL

[75] Inventor: Frantz Krautzberger, Heidenheim-Grosskuchen, Fed. Rep. of Germany

[73] Assignee: J. M. Voith GmbH, Fed. Rep. of Germany

[21] Appl. No.: 657,227

[22] Filed: Oct. 3, 1984

[30] Foreign Application Priority Data

Oct. 12, 1983 [DE] Fed. Rep. of Germany ..... 3337052

[51] Int. Cl.[4] ..... B05C 5/02

[52] U.S. Cl. ..... 118/610; 118/410; 118/413

[58] Field of Search ..... 118/603, 610, 410, 413

[56] References Cited

U.S. PATENT DOCUMENTS 3,303,816 2/1967 Lauring ..... 118/603

4,340,011 7/1982 Wahren et al. ..... 118/413 X 4,495,888 1/1985 Wohrle et al. ..... 118/413 X

FOREIGN PATENT DOCUMENTS 1964908 8/1970 Fed. Rep. of Germany ..... 118/414

*Primary Examiner*—John P. McIntosh

*Attorney, Agent, or Firm*—Ostrolenk, Faber, Gerb & Soffen

[57] ABSTRACT

A coating device in which a web of material is guided along a counter-roll at least in the region of a chamber which supplies coating composition to the web is disclosed. A feed channel is arranged in the chamber and is directed parallel to the counter-roll and extends along the chamber at least over the maximum width of the web of paper. Parallel to the feed channel there is a discharge channel for discharging gases contained in the coating composition located in the feed channel. The discharge channel is connected to the feed channel at several points along its length through openings present on the top of the feed channel.

9 Claims, 2 Drawing Figures

COATING DEVICE FOR COATING TRAVELING WEBS OF MATERIAL

BACKGROUND OF THE INVENTION

The present invention relates to a coating device for coating traveling webs of material. More particularly, the present invention is directed towards a coating device for coating traveling webs of material, particularly webs of paper, which are guided between a counter-roll and a chamber for feeding coating composition to the web of material. Such a coating device is disclosed in U.S. Pat. No. 3,980,043.

In the coating device disclosed in the foregoing patent, the chamber for receiving the coating composition, usually under pressure, is formed in the shape of an annular space having a slit-like opening facing the web of material to be coated and extending substantially the entire operating width of the counter-roll. Coating material is supplied to the annular space by a feed pipe which extends through the space coaxially therewith. A plurality of outlet openings are formed at spaced locations along the feed pipe on the side of the annular space opposite the slit-like outlet opening of the annular chamber and coating material enters the annular chamber through these openings. As a result of this arrangement, an optimally uniform feeding of coating composition to the web of material is assured, and dead spaces are avoided.

Unfortunately, such feed devices have the disadvantage that air or other gases which are unavoidably present in the coating composition cannot be removed before the application of the composition to the web of material. This leads to stiffness or other undesirable properties of the coating applied to the web of material.

For structural reasons, and to achieve the lightest possible weight, it is desirable in most cases to form the chamber in a triangular rather than an annular shape. The reason for this is as follows. The supporting beam which carries the doctor element (for example a coating blade) is formed, for reasons of strength, as a hollow girder. To minimize the number of structural elements and to reduce the weight of the coating device, the chamber for the coating composition is usually created by providing another wall on the outside of the hollow beam. This results in a chamber which has more of a triangular than an annular outer contour.

BRIEF DESCRIPTION OF THE INVENTION

The primary object of the present invention is to provide a device with which the disturbing gases in the coating composition are removed to the greatest extent possible before the coating composition reaches the web of material.

This object is achieved utilizing a coating composition feeding apparatus for feeding coating composition to a web of material moving past said apparatus, said apparatus comprising:

a hollow feeding chamber having a slit-like opening through which coating composition located in said chamber may flow from said chamber to a web of material moving past said slit-like opening;

a hollow feed channel located in said feeding chamber, said feed channel having a plurality of coating composition discharge openings formed at spaced locations therein though which coating compositions supplied to said channel under pressure may flow from said channel into said chamber; and a hollow discharge channel extending generally parallel to said feed channel and connected to said feed channel at a plurality of spaced locations along the length of said feed channel, whereby when said discharge channel and said feed channels are oriented with said discharge channel being located above said feed channel, gases entrained in said coating composition located in said feed channel can discharge from said feed channel to said discharge channel and thereby be removed from said coating composition.

This and other objects of the present invention are further achieved in accordance with the specified features of the preferred embodiment of the present invention described below. For example, the preferred embodiments further provide the advantage that dead zones in the chamber which change the viscosity and lead to accumulations of air are avoided.

BRIEF DESCRIPTION OF THE DRAWING

The invention will be described below with reference to two illustrative embodiments shown in the drawing, in which.

DETAILED DESCRIPTION OF THE PREFERRED EMBDIMENTS

Figure 1:
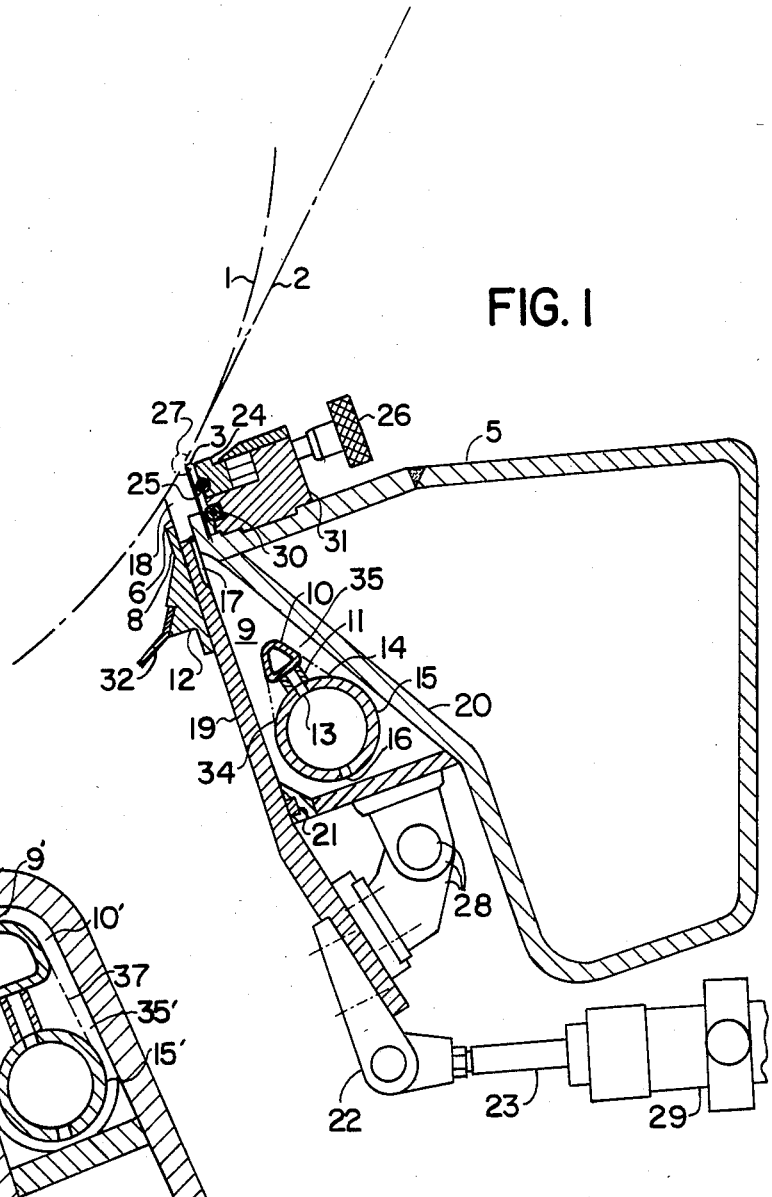
FIG. 1 is a coating device of the invention, shown diagramatically in cross-section.

In FIG. 1, the counter-roll is designated by the dot-dash line 1 and the web of paper by the dot-dash line 2. A coating blade 3, which serves as a doctor element, is secured to a holding beam 5 which is a hollow, partially welded, supporting structure. On opposite axial ends of the counter-roll 1, a respective limiting element 6 is provided. Each limiting element 6 lies in a respective plane extending perpendicular to the axis of the counter-roll 1 and extends between the doctor blade 3, a front wall 8 of support element 12, a chamber 9, the counter-roll 1 and/or the web of paper 2, and the edges of the chamber 9 which limit the outlet opening of the chamber. Only single limiting element 6 located at the remote axial end of the counter-roll 1 is shown in FIG. 1. Within the chamber 9, a small discharge channel 10 extends parallel to the axis of the counter-roll 1. Discharge channel 10 is connected at spaced points by transfer channels 11 to a larger, tubularly feed channel 15 which supports the channel 10. Coating composition is supplied to the feed channel 15 under pressure and is discharged into the chamber 9 via a plurality of outlet openings 16 located at spaced locations along the axial length of feed channel 15. Lateral guide walls 14, shown here in dot-dash line, provide a smooth transition between the small discharge channel 10 and the feed channel 15 and avoid the creating of dead spaces. The small channel 11 is located above the feed channel 15 in order that air bubbles entrained in the coating composition located in the feed channel 15 (which air bubbles will tend to rise and accumulate near the top of feed channel 15) can dicharge from the feed channel into the discharge channel 10 via openings 13 formed at spaced locations along the axial length of feed channel 15.

The outermost upper end of the front wall 8 cooperates with the counter-roll 1 and/or the paper web 2 to define a throttle slot from which excess coating composition emerges from the application zone 18. It discharges over a plate 32 which is fastened to a support element 12 bearing the front wall 8 of the application zone 18. The support element 12 is, in its turn, fastened to the front wall 19 of the chamber 9. The front wall 19 can be swung away from chamber 9 by means of a pivot joint 28 for cleaning and inspection of the chamber 9. To this end, the piston rod 23 of a hydraulic cylinder 29 is articulated to an arm 22 attached to the front wall 19 of the chamber 9.

A pressure element 25 in the form of a cylindrical bar serves to deform the coating blade 3 in order to obtain a desired application pressure to achieve a given thickness of coating. The pressure element is held in a pressure strip 24 which can be displayed by means of set screws 26. The coating blade 3 is fastened to the holding beam 5 by hose 30 which can be acted upon by fluid under pressure. The hose presses the blade 3 against the front end of the holding beam 5 as shown.

Each of the elements 24, 25, 26 and 30 are located within or on a holding strip 31 which is fixed in a groove in an upper wall of the holding beam 5, preferably by means of screws (not shown). Furthermore, there is shon in dot-dash line 27 a small circle through the center of which the application line of the coating blade 3 extends. The holding beam 5, and with it the elements supported by the holding beam 5, can be swung around an axis defined by the application line to adjust the angle of the doctor blade 3.

Uniform feed of the coating composition to the outlet slot 17 of the chamber 9 is assured by the holes 16 which are distributed over the length of feed channel 15. The small channel 10 serves as discharge channel for gases contained in the coating composition, particularly air. It is therefore connected at several spaced points along the length of the feed channel 15 by connecting channels 11 with the feed channel 15 via holes 13 arranged in the upper region of feed channel 15. Since air collects in the upper region of the feed channel, it will be discharged to the small channel 10 via the holes 13 and associated connecting channels 11. Of course, coating composition also enters into the discharge channel 10, but this is tolerated in order to achieve the main purpose, namely the removal of the air.

Due to the smooth transition from the discharge channel 10 to the feed channel 15 as a result of the guide walls 14, there is formed a flow body which is approximately triangular in cross section with a semicircle shape at its top apex. The semicircle flow body fills the chamber 9 to such an extent that only smooth channels 34, 35 remain on both sides of discharge channel 10 and feed channel 15 within this region of the chamber 9. In this way, no sharp corners are formed in the chamber 9 thereby avoiding eddying and the creation of dead spaces between the channels 10, 15. The dead space created at the apex of the triangle is also extremely small. In this way, there cannot be formed anywhere a stagnant accumulation of coating composition which could lead to a change in the consistency of the coating composition at these places which accumulated coating composition would unavoidably from time to time propogate itself to the application zone and to the web of material. If such were permitted to occur, stripes and furrows would be produced in the coating placed on the moving web. While not illustrated, the discharge channel 10 is brought out laterally from the chamber 9 in order to remove the coating composition contained therein with the included air from the system. After degasification, this part of the coating composition can be used again.

Figure 2:
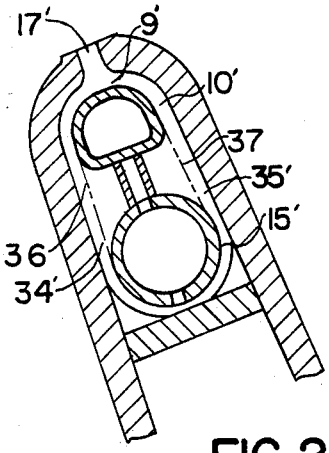
FIG. 2 shows a detail of another embodiment of the invention.

FIG. 2 shows the detail of the feeding chamber 9' in accordance with a second embodiment of the invention. In this embodiment, guide walls 36, 37 (shown in dot-dash line) are so located that the shape of the channel cross section of the channels 34' and 35' remains substantially constant up to the outlet opening 17' of the chamber 9'. This causes an acceleration of the flow to take place in the region of the outlet opening 17' so that dead spaces are avoided.

What is claimed is:

1. A coating composition feeding apparatus for feeding coating composition to a web of material moving past said apparatus, said apparatus comprising:

a hollow feeding chamber having a slit-like opening through which coating composition located in said chamber may flow from said chamber to a web of material moving past said slit-like opening;

a hollow feed channel located in said feeding chamber, said feed channel having a plurality of coating composition discharge openings formed at spaced locations therein through which coating composition supplied to said channel under pressure may flow from said channel into said chamber; and a hollow discharge channel extending generally parallel to said feed channel and connected to said feed channel at a plurality of spaced locations along the length of said feed channel, whereby when said discharge channel and said feed channels are oriented with said discharge channel being located above said feed channel, gases entrained in said coating composition located in said feed channel can discharge from said feed channel to said discharge channel and thereby be removed from said coating composition;

said openings discharging said coating composition into said feeding chamber in a direction opposite to the location of said slit-like opening;

said discharge channel being connected to said feed channel via a plurality of transfer channels extending generally perpendicular to said axis of said feed channel and coupled to said feed channel and said discharge channel at spaced axial locations along the length of said feed channel.

2. The apparatus of claim 1, wherein said slit-like opening, said feed channel and said discharge channel are all substantially straight and extend parallel to each other.

3. The apparatus of claim 2, wherein said feed channel extends substantially the entire length of said slit-like opening.

4. The apparatus of claim 1, wherein said transfer channels communicate with the top of said feed channel.

5. The apparatus of claim 1, further including means cooperating with said feed channel and said discharge channel to define a smooth flow body having a narrow end which faces said slit-like opening, said narrow end having an arcuate shape.

6. The apparatus of claim 5, wherein said means includes first and second guide walls extending from respective opposite sides of said feed channel to a respective opposite side of discharge channel and closing off an area located between said channels which area would define a dead space in the absence of said guide walls.

7. The apparatus of claim 6, wherein first and second smooth, unobstructed flow channels are defined between said first and second guide walls and first and second opposite walls of said feeding chamber.

8. The apparatus of claim 7, wherein coating composition supplied to said feed channel under pressure will discharge into a first area of said chamber and will flow from said first area through either said first or said second channels and then to said slit-like opening.

9. The apparatus of claim 7, wherein each of said flow channels has an approximately constant cross-section.

* * * * *